United States Patent [19]

Elesie et al.

[11] Patent Number: 4,666,161

[45] Date of Patent: May 19, 1987

[54] WORD DEFINITION GAME INCLUDING A RACE TRACK BOARD

[76] Inventors: Louis D. Elesie; Elizabeth R. Van Hart, both of 9900 Georgia Ave., Apt. 706, Silver Spring, Md. 20902; James J. Norwood; Pauline M. Norwood, both of 15008 Sunflower Ct., Rockville, Md. 20853; Joseph W. Dixon; Eleanor M. Dixon, both of 14971 258th Ave., SE., Issaquah, Wash. 98027

[21] Appl. No.: 690,268

[22] Filed: Jan. 10, 1985

[51] Int. Cl.[4] ..... A63F 3/00

[52] U.S. Cl. ..... 273/246; 273/240; 273/249

[58] Field of Search ..... 273/242, 272, 248, 249, 273/86 A, 246

[56] References Cited

U.S. PATENT DOCUMENTS

| | | | |
|---|---|---|---|
| 1,201,100 | 10/1916 | Rice-Wray | 273/272 X |
| 1,411,574 | 4/1922 | Mann . | |
| 1,544,591 | 7/1925 | Murray | 273/246 |
| 2,010,558 | 8/1935 | Neuzil | 273/246 |
| 2,823,919 | 2/1958 | Scruggs . | |
| 3,834,709 | 9/1974 | Lamb . | |
| 3,883,143 | 5/1975 | Kelley et al. . | |
| 3,935,651 | 2/1976 | Mankoff et al. . | |
| 3,963,243 | 6/1976 | Contento . | |
| 4,121,823 | 10/1978 | McBride | 273/249 |
| 4,123,051 | 10/1978 | Tsacoyannis | 273/272 X |
| 4,306,725 | 12/1981 | Sawyer . | |
| 4,315,627 | 2/1982 | Schlegel et al. | 273/249 |
| 4,487,418 | 12/1984 | Allen | 273/242 |

FOREIGN PATENT DOCUMENTS

| | | | |
|---|---|---|---|
| 759318 | 2/1934 | France | 273/246 |
| 923643 | 2/1947 | France . | |
| 626731 | 7/1949 | United Kingdom . | |
| 704417 | 2/1954 | United Kingdom | 273/246 |

OTHER PUBLICATIONS

"Fictionary Dictionary", Games and Puzzles Magazine, 9-77, pp. 15-16.

*Primary Examiner*—Richard C. Pinkham
*Assistant Examiner*—Matthew L. Schneider
*Attorney, Agent, or Firm*—Oblon, Fisher, Spivak, McClelland & Maier

[57] ABSTRACT

A racing board game for at least four players which includes a board having a plurality of sequential primary spaces indicated thereon, a starting portion and a finishing portion; a plurality of cards having word definitions appearing thereon and adapted for a chance selection of a word one at a time; a plurality of playing members having indicia thereon corresponding to each of the players; and a mechanism for determining the number of spaces to be traversed by each playing member in accordance to established game rules. The board also includes a plurality of secondary spaces that represent alternate starting spaces. The secondary spaces have indicia thereon indicative of different odds. A player beginning on one of the secondary spaces can win more money as dictated by the odds indicia then would a person who started on the starting space.

9 Claims, 9 Drawing Figures

WORD DEFINITION GAME INCLUDING A RACE TRACK BOARD

BACKGROUND OF THE INVENTION

1. Field of the Invention

This invention relates to a board game, and more particularly a racing board game which simulates a horse race and which is based upon correct identification of the definition of words.

2. Description of the Prior Art

Various board games which simulate a race have been proposed but such have typically been controlled based upon the roll of dice and thus arbitrary considerations with respect to the eventual winner of the game. It has therefore been recognized that there is a need for a game which is both stimulating and enjoyable and which also allows for self-improvement of the individual players.

SUMMARY OF THE INVENTION

The object of the present invention is to provide a racing game wherein the players vocabularies will be increased and wherein perception, deception and chance will determine the eventual winner.

According to the present invention, a racing board game is provided for at least four players and includes a board having a plurality of serially separated, sequential, primary spaces indicated thereon, a starting portion and a finishing portion; a plurality of cards having word definitions appearing thereon and adapted for chance selection of a word one at a time; a plurality of playing members having indicia thereon corresponding to each of the players; and means for determining the number of spaces to be traversed by each playing member in response to proper identification by at least one of said members of the definition of a word appearing on a selected card.

In accordance with the invention, the selected definitions as designated by each player is compared with the definition set forth on the card and points are then granted to either the players who have correctly identified the definition or to the starter player who has selected the card. In addition, players whose incorrect definitions have been chosen can receive additional points.

A further object of the present invention is to provide a board game which stimulates the players and allows the players to be creative, deceptive and perceptive as well as improving their vocabulary.

BRIEF DESCRIPTION OF THE DRAWINGS

Various objects, features and attendant advantages of the present invention will be more fully appreciated as the same becomes better understood from the following detailed description when considered in connection with the accompanying drawings in which like reference characters designate like or corresponding parts throughout the several views and wherein.

DETAILED DESCRIPTION OF THE PREFERRED EMBODIMENT

Figure 1:
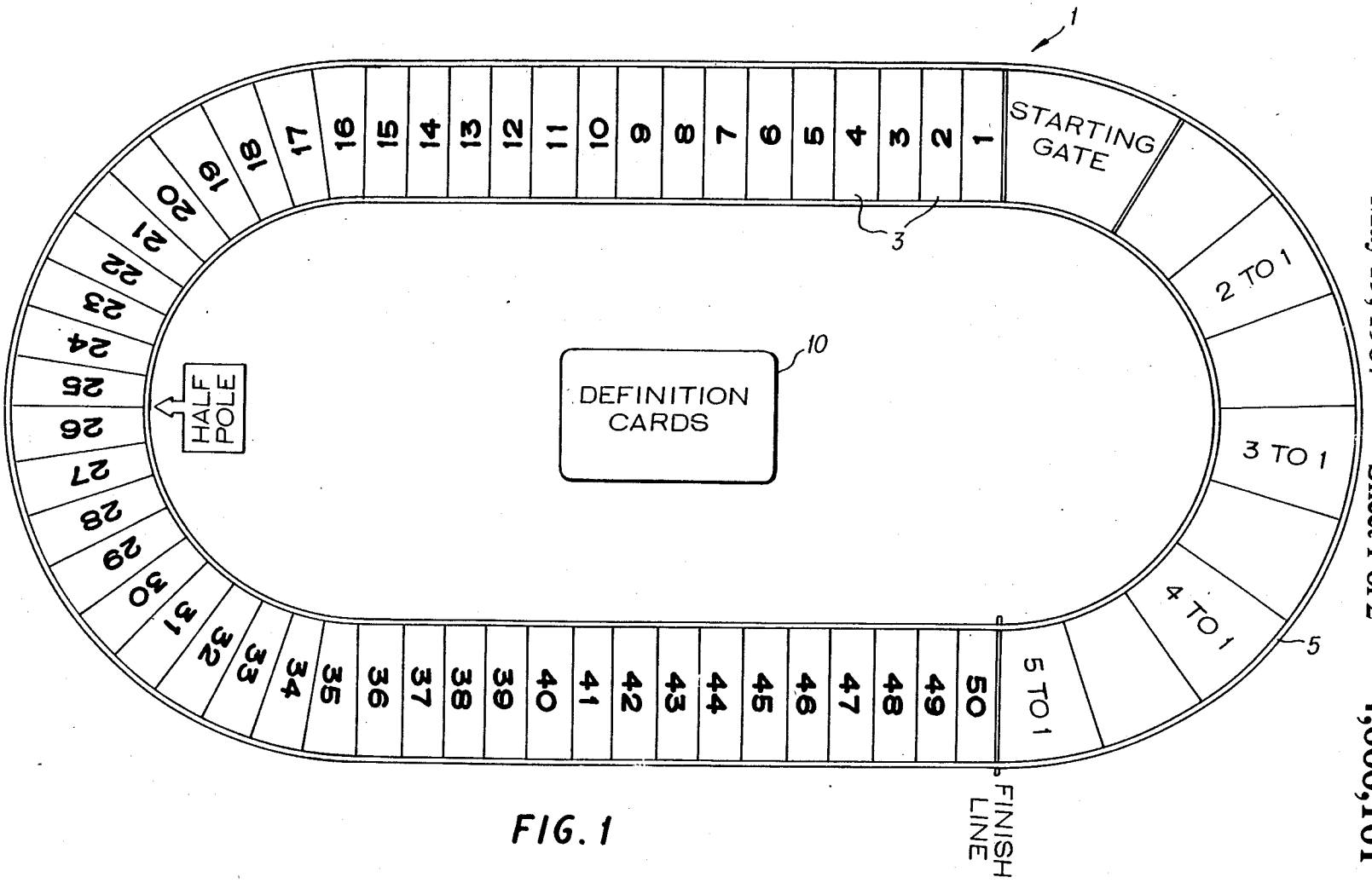
FIG. 1 shows a board which simulates a racetrack for horses and which includes additional racing information.
Figure 2:
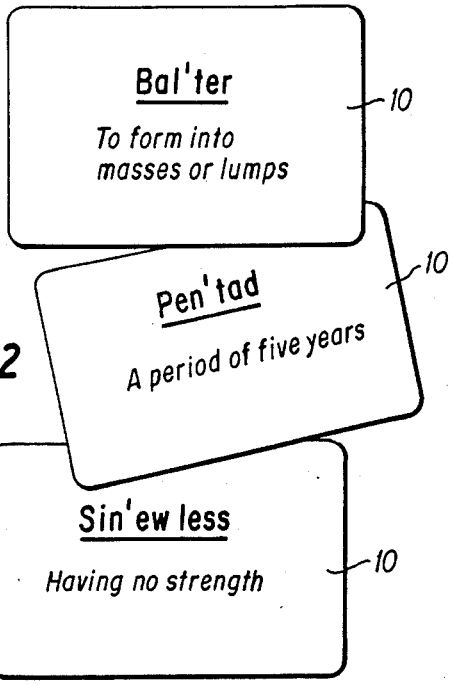
FIG. 2 illustrates three typical cards selected from a deck of cards which serve to properly define different words that the players are asked to define.
Figure 3:
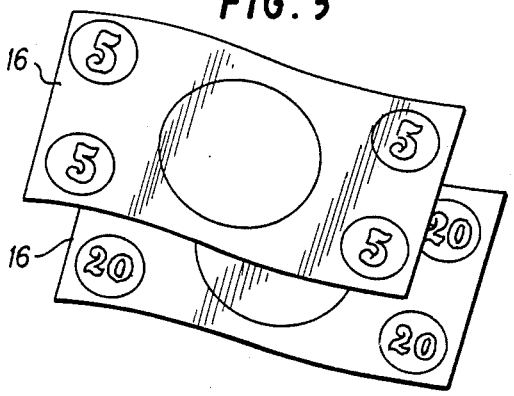
FIG. 3 shows play money used by the individual players during the course of the game.
Figure 4:
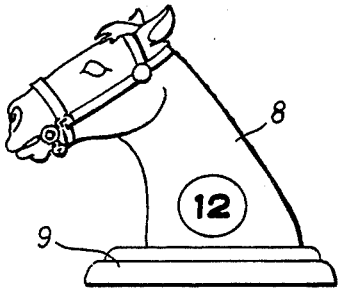
FIG. 4 illustrates three playing members in the form of the heads of horses and which includes the proper numeric identification corresponding to each player.
Figure 5A:
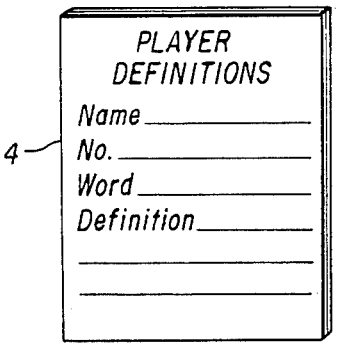
FIGS. 5*a* and 5*b* indicate a definition pad used by each player and a secretary's pad, respectively.
Figure 5B:
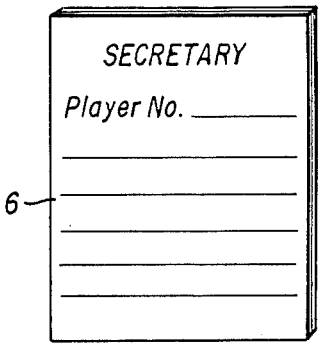
Figure 8:
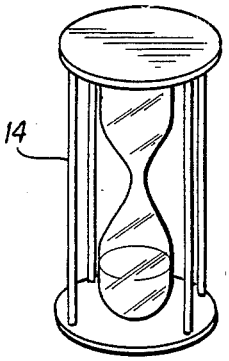
FIG. 8 illustrates a timing device used in connection with playing of the game.
Figure 6:
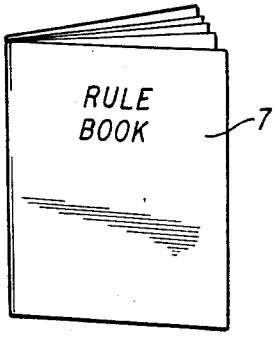
FIG. 6 shows a rule book which serves to control the course of conduct of the game.
Figure 7:
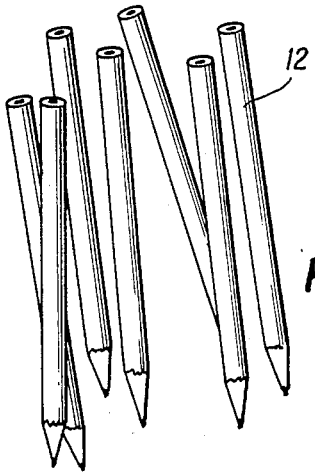
FIG. 7 illustrated pencils or pens which can be used in conjunction with the definition pad and secretary's pad shown in FIG. 5*a*, 5*b*.

As illustrated in the above-noted Figures, the racing game in accordance with the present invention allows for a player to reach the finish line first by winning the most points based upon his or her ability to create, to perceive, to deceive plus an element of chance. This game is suitable for groups of 4–12 players with the ideal number being 6–8 players. As illustrated, the game equipment includes a racetrack board 1, a plurality of plastic horses 2 having a base portion 9; a plurality of player definition pads 4 to be respectively used by each player; a secretary's pad 6 whose function will be explained in more detail hereinbelow; and a rule book 8 which contains instructions based upon the following discussion. Also required for playing of this game is a plurality of word definition cards 10 as well as a plurality of pencils or pens 12, a timing device such as a sandglass 14, and sufficient play money 16 to allow the object of the game to be attained.

DESCRIPTION OF PLAY

As can be appreciated from a review of the Figures, each player chooses his or her preferred plastic horse 2 and also utilizes pencil or pen 12 and a sheet of paper from the player definition pad 4. One person is required to serve as secretary and this individual also obtains a sheet from the secretary's pad 6.

Although any denomination of play money can be used, each player can, for example, obtain fifteen hundred dollars ($1,500) in play money. In beginning the game, one of the players is selected to be the first starter and the deck of word cards 10 containing the definition of various words is placed face down on the racetrack board 1.

The beginning step of the game involves the starter picking the top card from the deck of word cards 1. The starter pronounces and spells the word out loud but does not reveal the definition of that word. At this point, any player who knows the correct definition of the selected word must state that this word be "scratched" as being unacceptable. The starter would thereupon pick another word card from the deck.

Once a word card with a word has been selected by the starter and not "scratched", each player writes his or her name and the announced word on his definition pad 4. Each player also creates his or her own definition of the selected word, striving to deceive their opponents and cause them to incorrectly choose that player's offered definition as the correct definition. The timer 14 is used to limit the writing time and thus not impede the progress of the game.

As the players are writing their definitions, the starter writes the proper, correct definition on his definition pad as the definition correctly appears on the card. The selected starter then collects all the definitions from the various players, including his own. Being careful not to give clues as to the players identities, the starter reads each definition to the group of players. The secretary writes down on the secretary's pad 6 a listing of each definition as they are read by the starter. At this point, each player decides in silence which definition is indeed the true and correct definition. The secretary passes the list of definitions to each player so as to allow each player to make his or her choice by writing the number of that player's horse next to the chosen definition. The starter then reveals the correct definition, that being the one written by the starter based upon the definition as it appeared on the card 10 selected from the deck of cards.

The reward or pay-off to the players occurs as follows. First, players who correctly identify the starter's proper definition can, for example, obtain two points. Should no player pick the correct definition, the starter gets five points. The players whose incorrect definitions were chosen as correct receive three points. Based upon these point totals, each player and the starter advances his or her playing member in the form of each selected plastic horse 2 on the board according to the serially separated and sequential primary spaces 1–50 as shown in FIG. 1.

After the players who have received points have moved their plastic horses ahead on the board, the player to the left of the first starter now becomes the second starter and play continues with the second starter picking a new word from the deck of cards. During the course of the game, it can be possible for each player to take a turn being the starter. The player whose horse reaches the finish line first is determined to be the winner. Each player will pay the player with the winning horse $100. It is further understood that the first player to reach or pass the half-pole space (i.e. halfway between the starting gate and the finishing line) collects twenty (20) dollars from each of the other players, including the starter.

As a variation on the basic game described above, it is also envisioned that each player may wish to position his racing horse 2 at one of the designated spaces 5 indicating odds of two to one; three to one; four to one or five to one, these constituting secondary spaces positioned between the starting gate or starting portion and the finishing line or finishing portion. If for example, a player picks "five to one", he or she must place their horse 2 on that space on the race board 1. This means that his or her horse will have to race farther to win, but if such occurs, that player will be paid off at a rate of five to one, i.e., five hundred dollars ($500) rather than one hundred ($100) from each player.

Obviously, numerous modifications and variations of the present invention are possible in light of the above teachings. It is therefore to be understood that within the scope of the appended claims, the invention may be practiced otherwise than as specifically described herein.

What is claimed as new and desired to be secured by Letters Patent of the United States is:

1. A racing board game for at least four players, comprising:

a board having a plurality of sequential primary spaces and a plurality of secondary spaces indicated thereon, said primary spaces being sequentially enumerated and forming a starting portion and a finishing portion, said secondary spaces being positioned in a remaining portion of said board and respectively including a designation of different ratios indicating a multiple pay back to a player whose playing member is positioned thereon upon said playing member being the first playing member to cross said finishing portion;

a plurality of cards having word definitions appearing thereon and adapted for chance selection of a word one at a time; and a plurality of playing members having indicia thereon corresponding to each of said players.

2. A racing board game for at least four players, comprising:

a board having a plurality of sequential spaces marked thereon so as to form a playing path, said playing path of sequential spaces comprising a plurality of primary spaces including a first primary space and a last primary space, a plurality of secondary spaces positioned in a remaining portion of said board, and a main starting space disposed in said path between said first primary space and said plurality of secondary spaces, said plurality of secondary spaces comprising at least one alternative starting space, there being a finish line marked on said board across said playing path and substantially coinciding with an edge of said last primary space;

a plurality of cards having word definitions appearing thereon and adapted for chance selection of a word one at a time; and a plurality of playing members having bases sized to fit entirely within a single primary or secondary space and having indicia thereon corresponding to each of said players, wherein said primary spaces are sequentially enumerated and wherein said secondary spaces comprise plural alternative starting spaces respectively marked with designations of different ratios indicating a multiple pay back to a player whose playing member is positioned thereon upon said playing member being the first playing member to cross said finish line.

3. A racing board game as set forth in claim 2, wherein said board defines a horse race track, said playing member comprising a member in the shape of a horse head mounted on a base portion.

4. A racing board game as set forth in claim 2, further comprising a timing mechanism operable to indicate a time sequence within which each player can attempt to define said word appearing on said card selected from said plurality of cards.

5. A racing board game as set forth in claim 2, further comprising indicia located on said board for designating a halfway point of the primary spaces.

6. A racing board game as set forth in claim 2, wherein each of said cards contains a word which differs from that contained on any other card within said plurality of cards, said word being followed on said card by the definition of said word.

7. A racing board game as set forth in claim 2, further comprising means for recording definition determined by each player for the word displayed on said card that has been selected.

8. A racing board game as set forth in claim 2, wherein said playing path of sequential spaces is in the form of a common path for said playing members and is shaped as an oval racetrack.

9. A racing board game as set forth in claim 2, wherein said primary spaces are sequentially marked.

* * * * *